US007914406B2

(12) United States Patent
Andrews

(10) Patent No.: US 7,914,406 B2
(45) Date of Patent: Mar. 29, 2011

(54) ARROW VANE AND ARROW WITH VANE

(75) Inventor: Dave Andrews, Frackville, PA (US)

(73) Assignee: The Bohning Company, Ltd., Lake City, MI (US)

( * ) Notice: Subject to any disclaimer, the term of this patent is extended or adjusted under 35 U.S.C. 154(b) by 523 days.

(21) Appl. No.: 12/017,805

(22) Filed: Jan. 22, 2008

(65) Prior Publication Data

US 2009/0186723 A1 Jul. 23, 2009

(51) Int. Cl.
*A63B 65/02* (2006.01)

(52) U.S. Cl. ..... 473/586; 473/578; 473/580; 473/585

(58) Field of Classification Search ..... 473/578, 473/580, 585, 586
See application file for complete search history.

(56) References Cited

U.S. PATENT DOCUMENTS 1,648,376 A * 11/1927 Blodgett ..... 269/38
1,842,540 A * 1/1932 Cowdery ..... 473/586
2,277,743 A * 3/1942 Burns ..... 473/586
2,782,036 A * 2/1957 Folberth, Jr. et al. ..... 473/586
2,830,818 A * 4/1958 Otto ..... 473/586
2,887,319 A * 5/1959 Lay ..... 473/586
2,976,043 A * 3/1961 Meyer ..... 473/586
3,595,579 A * 7/1971 Benoit ..... 473/586
3,667,758 A * 6/1972 Bengtsson ..... 473/586
3,749,403 A * 7/1973 Austin et al. ..... 473/586
3,815,916 A * 6/1974 Meszaros ..... 473/586
4,204,307 A * 5/1980 Pfetzing ..... 29/407.09
4,392,654 A * 7/1983 Carella ..... 473/586
4,477,084 A * 10/1984 Austin ..... 473/586
4,488,728 A * 12/1984 Humphrey ..... 473/586
4,615,552 A * 10/1986 Bengtson ..... 473/586
5,024,448 A * 6/1991 Barrie ..... 473/586
5,039,110 A * 8/1991 Honda ..... 473/586
5,427,385 A * 6/1995 Conrad et al. ..... 473/586
5,439,231 A * 8/1995 Roberts et al. ..... 473/586
5,443,272 A * 8/1995 Vincent, Sr. ..... 473/578
5,443,273 A * 8/1995 Lovorn ..... 473/586
5,613,688 A * 3/1997 Carella ..... 473/586
5,846,147 A * 12/1998 Basik ..... 473/586
5,897,449 A * 4/1999 Roberts et al. ..... 473/586
6,129,642 A * 10/2000 DonTigny ..... 473/578
6,142,896 A * 11/2000 Simo et al. ..... 473/586
6,220,978 B1 * 4/2001 Schroeder ..... 473/586
6,641,493 B1 * 11/2003 Shifflett ..... 473/578
6,695,727 B1 * 2/2004 Kuhn ..... 473/586
6,958,023 B2 * 10/2005 Simo et al. ..... 473/586
7,074,143 B2 * 7/2006 Czemske et al. ..... 473/586
7,229,371 B2 * 6/2007 Walsh ..... 473/586
7,485,057 B2 * 2/2009 Afshari ..... 473/586
7,758,457 B2 * 7/2010 Marshall ..... 473/586
2002/0028718 A1 * 3/2002 Coe ..... 473/586
2005/0159256 A1 * 7/2005 Simo et al. ..... 473/586

(Continued)

*Primary Examiner* — Gene Kim
*Assistant Examiner* — Alexander R Niconovich
(74) *Attorney, Agent, or Firm* — Smith Frohwein Tempel Greenlee Blaha, LLC; Gregory Scott Smith

(57) ABSTRACT

A vane that can be mounted to a projectile to provide stability of flight, without substantially degrading speed due to added weight and/or causing clearance concerns. The vane is approximately 1.85 inches long and 0.465 inches high with a front-edge and a back-edge that meet at a point. The back-edge arcs down towards the base of the vane while the front edge degrades in a substantially linear fashion to the base of the vane.

12 Claims, 3 Drawing Sheets

U.S. PATENT DOCUMENTS

| | | | | |
|---|---|---|---|---|
| 2006/0183579 | A1* | 8/2006 | Afshari | 473/586 |
| 2006/0258491 | A1* | 11/2006 | Walsh | 473/578 |
| 2006/0293131 | A1* | 12/2006 | Jirles | 473/578 |
| 2007/0173359 | A1* | 7/2007 | Mowery et al. | 473/578 |
| 2007/0259743 | A1* | 11/2007 | Sims et al. | 473/578 |
| 2008/0176682 | A1* | 7/2008 | Marshall | 473/586 |
| 2008/0176683 | A1* | 7/2008 | Marshall | 473/586 |
| 2008/0207362 | A1* | 8/2008 | Kuhn | 473/586 |
| 2008/0242456 | A1* | 10/2008 | Harsh | 473/586 |
| 2009/0111622 | A1* | 4/2009 | Klein | 473/586 |
| 2010/0151976 | A1* | 6/2010 | Marshall | 473/586 |
| 2010/0167849 | A1* | 7/2010 | Malucelli | 473/586 |

* cited by examiner

ARROW VANE AND ARROW WITH VANE

CROSS-REFERENCE TO RELATED APPLICATIONS

This application is related to U.S. Design patent application Ser. No. 29/302,669 filed concurrently herewith having a title of ARROW VANE.

BACKGROUND OF THE INVENTION

The instant invention is generally directed to the field of archery, and archery arrows, and, more specifically to the field of vane structures for archery arrows to affect flight characteristics.

The laws uncovered through the study of aerodynamics have been applied in numerous fields to gain performance improvements. Such application have included the designs of airplanes, jets, missiles, rockets, automobiles, bicycles, boats, submarines, bullets, speed ice skaters, horse racing, as well as many more. One particular area of interest has been in the development and improvement of arrow designs.

There are hunters of all varieties, but there is a special sect of hunters that is quite unique. These are the bow and arrow hunters. They have their own reserved portion of the typical hunting season, and when you talk to them about it, they have a little gleam in their eye—like they know a secret that few others are aware of. Some have said that if you try it once, you will be hooked. What is it about hunting with a bow and arrow that draws certain people into that special nook of the sport of hunting? Is it the simplicity, is it the quietness, is it that it is closer to the way our ancestors had to survive? The answer may be different for every such hunter. However, one thing that is common to most bow and arrow hunters—they want their shots to count. And as such, they want arrows that are designed to get the job done. They want arrows that fly in a stable manner, and that are fast.

One of the key elements that affect flight speed and stabilization in an arrow is the structure of the vanes. Long before any degrees in aerodynamics were offered, hunters were putting vanes onto their arrows. Findings have verified that at least as early as 7000 BC hunters were attaching feathers to the end of an arrow as vanes. Vanes for arrows, which can be described as a guiding fin, are thus widely known in the art and have most likely been used since the inception of archery.

Vanes can be constructed out of natural materials, such as feathers or synthetic materials. Vanes are typically mounted parallel to the shaft of an arrow, in a plurality arrangement. Vanes provide in-flight arrow stabilization particularly in the hunting archery field, for hunting points or "broadheads." Hunting points, with more weight, have long provided stabilization challenges. The traditional solution for increasing stabilization for broadhead laden arrows, has been to increase the size of the vanes. Although larger vanes have been successfully used to solve erratic flight/stabilization problems, their use has created additional limitations and problems. For instance, increased vane sizes tend to increase the overall weight of the arrow, which reduces arrow speed and, thus, its effectiveness. Furthermore, larger vane sizes may also create "clearance" problems with the arrow, and other parts of the bow or projectile device.

While it has long been a goal, in the archery field, as stated, to provide improved in-flight arrow stabilization, particularly when using arrow points with added weight, the prior art does not disclose any solutions to this problem utilizing vanes, or feathers, which are normally not of at least a four inch length or greater. The prior art clearly demonstrates a long-standing need for a durable, smaller arrow vane solution.

When practicing at a range, archers typically use a different arrow configuration than what would be used during a hunt. Generally, the broadheads used for hunting are heavier and more expensive. Using these broadheads at the range would dull the points thus decreasing their effectiveness. Thus, at the range archers typically use different points. The heavier broadheads typically required larger vanes whereas the smaller practice heads could get by with smaller vanes. As a result, arrow flight at the range can be significantly different from out in the field. What is needed in the art is an arrow structure that provides consistency in arrow flight, as well as look and feel, between the range and the field.

These, as well as other needs in the art are addressed in the various embodiments of the invention as presented herein.

BRIEF SUMMARY OF THE INVENTION

The various embodiments, features and aspects of the present invention overcome and/or alleviate some of the short comings in the above-noted prior art. In general, embodiments of the invention are directed towards the provision of an arrow vane that can be used under a large array of archery conditions. More particularly, embodiments of the present invention can advantageously provide greater stability in arrow flight when needed, because of greater arrowhead weight, and where alternatives have been to increase the size of the vane.

Additional short-comings, which are addressed by various embodiments of the present invention, include (a) providing a vane structure that does not unnecessarily increase the weight of the arrow, which in turn would, limit arrow speed and reduce effectiveness and (b) providing a vane structure that does not create clearance issues with parts of the archery bow assembly or other arrow projective device upon release of the arrow.

The various embodiments of the present invention provide consistent in-flight steerage and stabilization with broadhead arrows, and others, using the shortest and smallest vane available. The shorter vane provides less chance of interference with the arrow rest or bow cradle and weighs less than a normal vane. Less vane weight results in increased arrow speed and improved arrow trajectory.

Advantageously, the various embodiments of the present invention, as described, allows hunters to sight in with field tips and then switch to broadhead without changing the arrow impact point. Further, testing by the inventors has shown that, while some spin is necessary for accurate flight, a longer vane is not the optimum answer. What is required is a guidance system, such as that provided, which provides stable guidance to the arrow, irrespective of what the arrow tip is doing. The various embodiments of the present invention, with its unique design, creates turbulence behind the arrow, and not around the longer vanes and feathers, as may occur when those are used as fletchings. The various embodiments of the present invention operate to begin steering and correcting, almost immediately upon release, using the stated combination of a steep leading edge and the height and length ratio, and material stiffness. These features prevent larger broadheads from planing or steering the arrow shaft. The air flows over the vane in a manner which can actually create lift, and is particularly noticeable in longer distances at flat trajectory. Advantageously, the various embodiments of the present invention provide substantial benefit in trajectory, precision and velocity at target.

The above-described and additional features of the invention may be considered, and will become apparent in conjunction with the drawings, in particular, and the detailed description which follow.

DETAILED DESCRIPTION OF THE INVENTION

The present invention, as well as features and aspects thereof, is directed towards providing a vane that can be attached to an arrow shaft that provides substantial stabilization in arrow flight, while not increasing the weight of the arrow and/or creating clearance problems with a bow.

The present invention includes an arrow vane structure which, through its design characteristics, generally promotes arrow flight stability and consistent flight with differing arrowhead weights, without requiring additional vane side or surface area. In general, embodiments of the invention include a primary vane member. The vane member is substantially rigid to maintain its shape and position during arrow flight, but may be constructed of resiliently bendable material, synthetic or otherwise, which allow bending when contacted by force, but which will subsequently return to its original shape.

Turning now to the figures in which like labels refer to like elements throughout the several views, various embodiments, aspects and features of the present invention are presented.

Figure 1A:
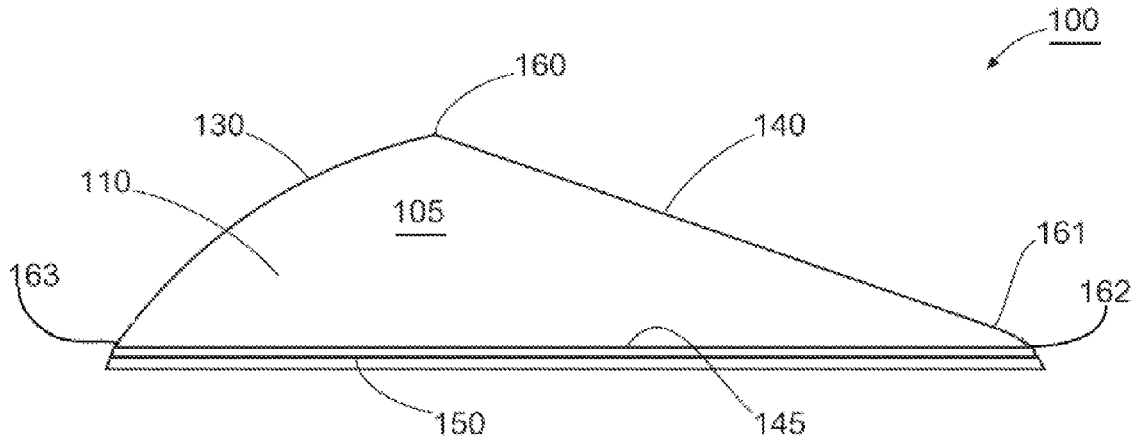
FIG. 1A is a side-profile diagram of an embodiment of a vane incorporating aspects of the present invention.

FIG. 1A is a side-profile diagram of an embodiment of a vane incorporating aspects of the present invention. The vane member 100 includes two main components, the vane fin 105 and the vane base 150. The vane fin 105 is a flat piece of material having a right-side planar surface 110 and a left-side planar surface 120 (not shown in this FIG. 1A). The shape of the vane fin 105 is defined by a back-edge or rear-edge 130, a front-edge 140 and a base edge 145. Traversing the contour of the vane fin 105, the back-edge 130 is an arc that extends upward from point 163 where it meets the base edge 145, to point 160 (the top of the vane 100) where it meets the rearward end of the front-edge 140. The front-edge 140 then extends in downward and in a substantially linear fashion towards point 162 were it meets the base edge 145; however, at point 161 the front-edge 140 changes from linear to a downward arc. The based edge 145 extends from point 162 in a linear fashion to point 163.

Figure 1B:
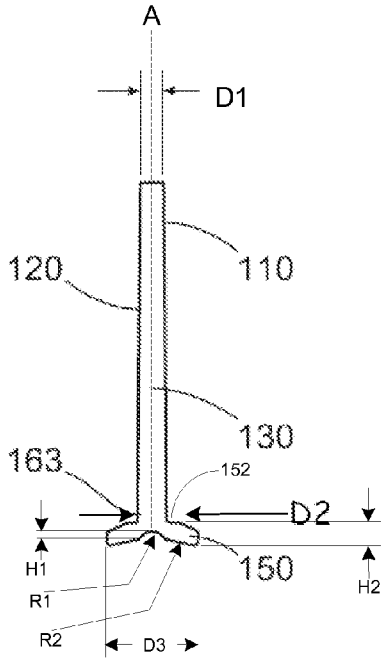
FIG. 1B is a rear-profile diagram of the embodiment illustrated in FIG. 1.
Figure 1C:
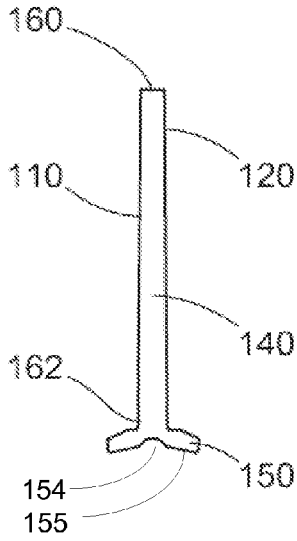
FIG. 1C is a front-profile diagram of the embodiment illustrated in FIG. 1.

FIG. 1B is a rear-profile diagram of the embodiment illustrated in FIG. 1. FIG. 1C is a front-profile diagram of the embodiment illustrated in FIG. 1. As shown in FIG. 1B, the right-side planar surface 110 and the left-side planar surface 120 are spaced apart by width to form the back-edge 130, front-edge 140 and base-edge 145, which in the illustrated embodiment, is slightly increases from the top of the vane 160 at D1 to the base edge 145 of the vane at D2. In other embodiments the width of the vane may be uniform from the top of the vane to the base edge 145. In an exemplary embodiment, the width D1 is approximately 0.025 inches at the top of the vane 160, and increasing linearly to width D2 of 0.029 inches near the base edge 145. However, it will be appreciated that although a particular value or range of values for D1 and D2 may be considered in and of itself novel, the present invention is not limited to any particular value, and/or to a linear progression from D1 to D2.

The base 150 is substantially perpendicular to the vane fin 105 and has a top surface 152 and a bottom surface. The top surface 152 of the base 150 is attached, adhered, adjoined, integral with or otherwise meets or corresponds with the bottom-edge 145 of the vane fin 105. The bottom surface of the base 150 is attachable to the surface of an arrow shaft. In some embodiments, the base 150 may be substantially box-shape with the top surface and the bottom surface being two substantially parallel and flat surfaces, joined together by four edges that are substantially perpendicular to the top surface and the bottom surface to form the box. In other embodiments, the bottom surface may be slightly arched similar to the surface of the shaft to which it will be attached. In yet other embodiments, the entire base may be slightly curved in accordance with the shaft. In yet even another embodiment, the bottom surface of the base 150 may be angled similar to an inverted V or may be slanted either left or right. Although the present invention is not limited to any particular structure for the base 150, it will be appreciated that the embodiments presented herein, may in and of themselves be considered novel aspects or features of various novel embodiments of the present invention. Although the base 150 is described as mounting to the surface of an object, it will be appreciated that the base could also be embedded in a slot of the surface or a recess. Also, any means utilized for standard size vanes may be utilized for affixation purposes, and vane 100 need only be susceptible of affixation to meet the requirements of the invention.

The base 150, in an exemplary embodiment of the invention is larger than the width of the vane fin. Typically, the width of the base 150 D3 is 0.1±0.010 inches. The illustrated base is mirrored around an axis extending through the vane from the base-edge 145 up through the top of the vane 160 as illustrated by the dotted line A. The height of the base H2 from the point 163 to the bottom is approximately 0.240 inches. Centered under the vane fin in the base 150 is a cup or recess 154 having a radius R1 of approximately 0.016 radians and a depth of H1. The feet of the base then extend downward at an angle with the underside of the feet 155 having a radius R2 of approximately 0.150 radians.

Figure 2A:
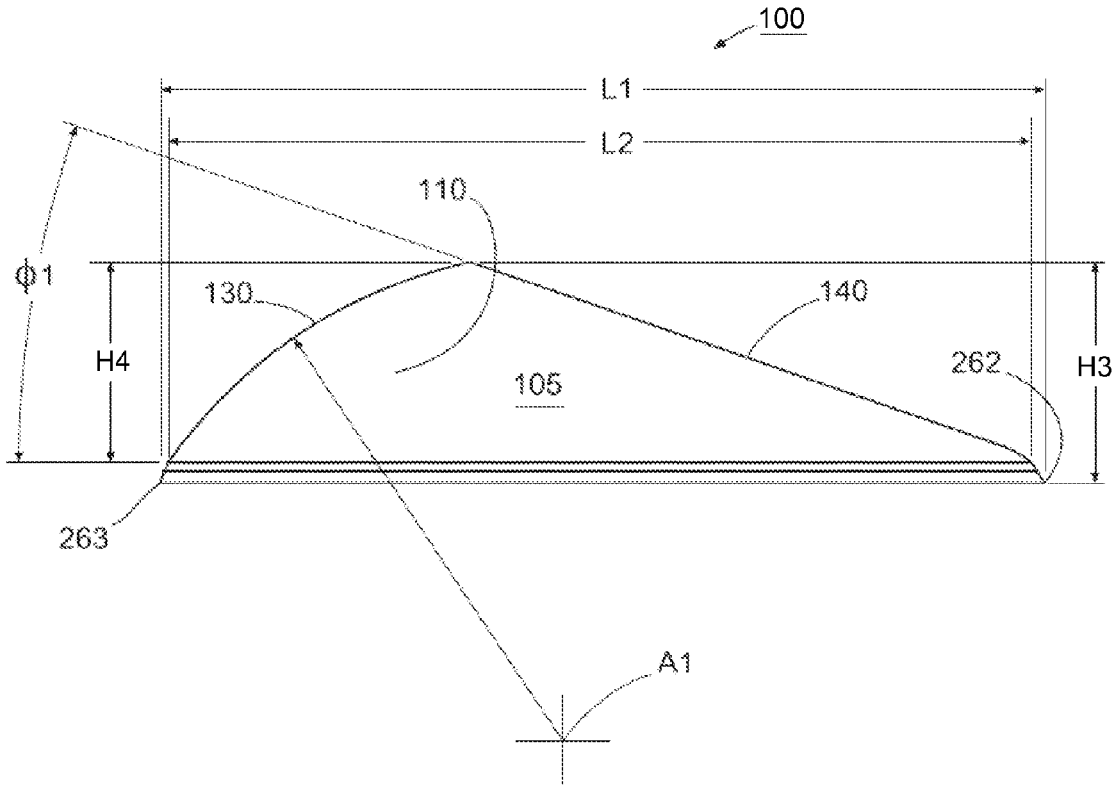
FIGS. 2A and 2B are side-profile diagrams of an embodiment of a vane incorporating aspects of the present invention and identifying particular dimensions and dimension ranges.
Figure 2B:
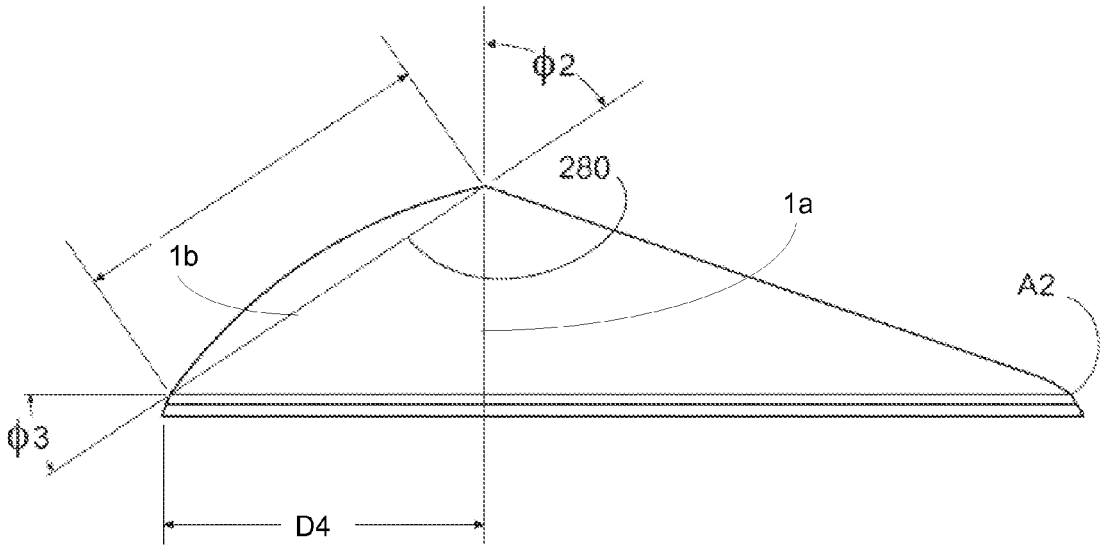

FIGS. 2A and 2B are side-profile diagrams of an embodiment of a vane incorporating aspects of the present invention and identifying particular dimensions and dimension ranges. The length L1 of the vane 100 is the distance from point 262 to point 263. The length L2 of the vane fin 105 is the distance from point 162 to point 163 and basically is the length of the bottom-edge 145. It will be appreciated that although the length L1 of the base 150 is illustrated and described as being longer than the length L2 of the vane fin, in some embodiments, the base 150 may be longer or shorter than the bottom-edge 145 (L1<L2) or the base 150 may be the same length as the base-edge 145 (L1=L2) and as such, the present invention is not limited to any particular relationship, although the various relationships may be considered as novel aspects of the present invention. Thus, in some embodiments, the length L1 is the length of the vane 100, whereas in other embodiments, the length L2 is the length of the vane 100, and yet in other embodiments, the lengths L1 and L2 are equal and represent the length of the vane 100.

In the illustrated embodiment, the bottom-edge 145, and hence, the length of the vane fin 105 is slightly shorter than the length of the base 150, or in this case the length of the vane 100. In an exemplary embodiment, the value of L1 is approximately 1.85 to 1.88 inches. Length L2 is slightly less than L1 and is approximately 1.815 inches.

The height of the vane 100 from the bottom surface of the base 150 to the top of the vane 160 is H3 and the height of the vane fin 105 from the bottom-edge 145 to the top of the vane 160 is H4. In an exemplary embodiment, H3 is 0.465 inches±0.005 inches and H2 is 0.437±0.005 inches. Thus, in the illustrated embodiment, the ration of the length of the vane to the height of the vane is approximately 4:1.

The front-edge 140 and the bottom-edge 145 form an angle Ø1 with the apex of the angle being proximate to point 162 and opening towards the rear-edge of the vane fin 105. In an exemplary embodiment, the value of Ø1 is approximately 20°±1°.

The back-edge 130 is an arc extending from point 163 to point 160, concave with relation to the point 162. In an exemplary embodiment, the radius of the arc A1 of the back-edge 130 is measured as approximately 1.032±0.005 radians.

As best seen in FIG. 2B, by extending a line (1*a*) from the top of the vane 160 towards the bottom-edge 145 and that is perpendicular to the bottom-edge, the intersection of line 1*a* and the bottom edge 145 is at approximately 0.65 inches D4 from the point 163 and towards the point 162. In addition, a line 1*b* extending from point 163 to point 160 (the chord of the radius) results in a line that has a length of approximately 0.783±0.005 inches and that forms angles of Ø2 equal to approximately 56° and Ø3 equal to approximately 34°.

Figure 3:
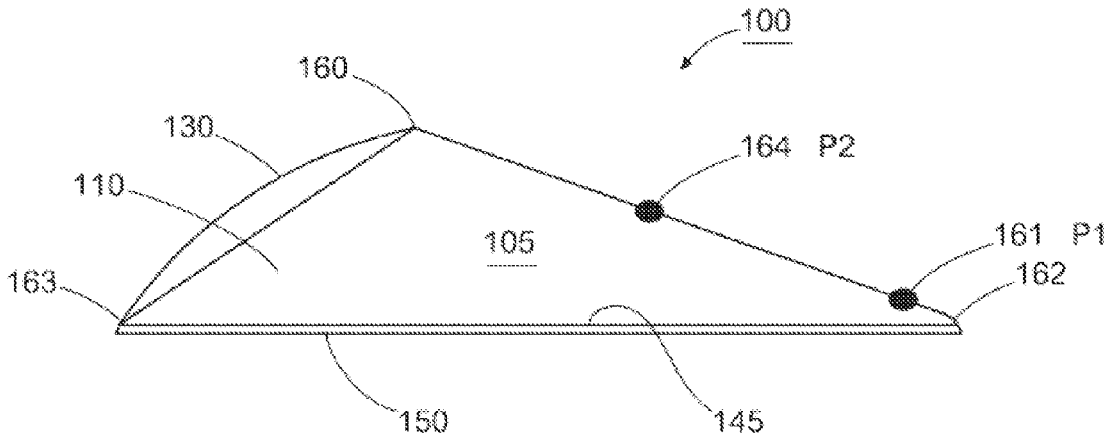
FIG. 3 illustrates another embodiment of the present invention dual arced front-edge.

FIG. 3 details the characteristics of the front-edge. In the illustration, the front-edge 140 is substantially linear from point 160 to point 161 and then the front-edge 140 arcs downwardly between point 161 and point 162 in a concave fashion relative to point 163 and at an arc A2 radius of 0.110±0.005 inches.

In another embodiment of the invention, the front-edge extends in a substantially linear fashion from point 160 to a point 164 somewhere between point 160 and 161. From this point, the front-edge then slightly tapers down at a greater angle, or slightly arcs downwardly towards point 161 in a concave fashion relative to point 163. Then the front-edge arcs downwardly from point 161 to point 162 concave relative to point 163 as described above.

In yet another embodiment, not illustrated, the front-edge of the vane fin is not linear at all but rather has one arc segment from point 160 to point 161 and then another arc segment from point 161 to point 162.

In yet another embodiment, not illustrated, the front-edge of the vane fin is a continuous compound arc of decreasing radius from point 160 to point 162.

Figure 4:
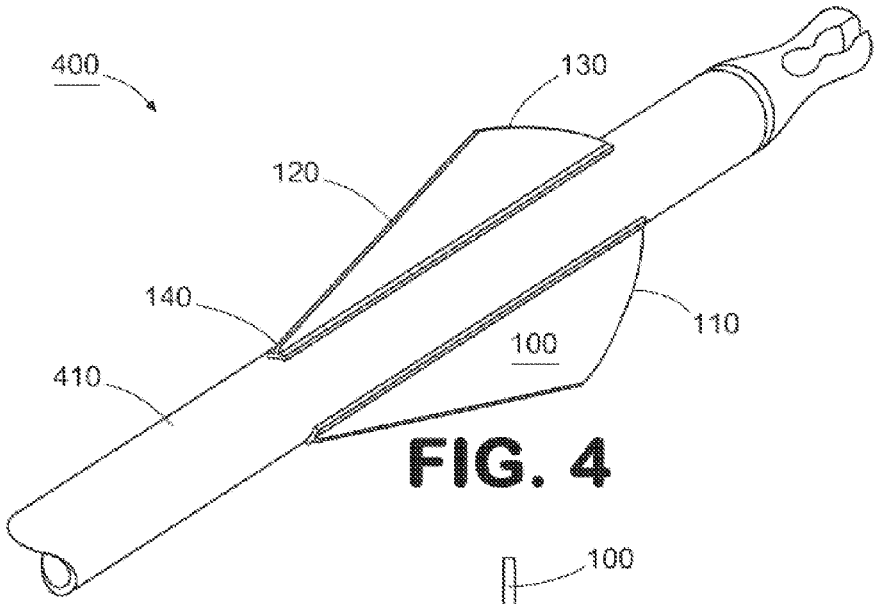
FIG. 4 is a perspective drawing of an arrow constructed with the above-described vanes.
Figure 5:
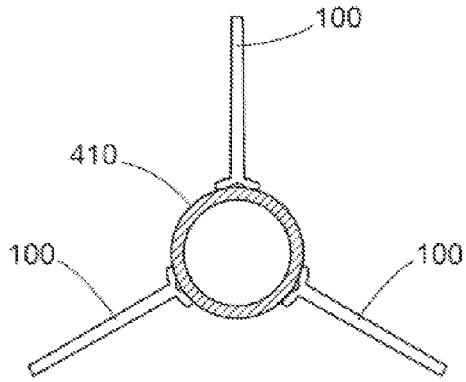
FIG. 5 is a front view of the arrow illustrated in FIG. 4.

FIG. 4 is a perspective drawing of an arrow constructed with the above-described vanes. FIG. 5 is a front view of the arrow illustrated in FIG. 4. The arrow includes a shaft 410 and a plurality of vanes 100. The vane 100 is normally attached in numerical combinations of three, as best seen in FIG. 5, although a greater number of vanes may be used and even lesser vanes can be used depending on the embodiment or use of the vane. It should be appreciated that the various embodiments of the described vane can be attached to a variety of objects or projectiles and although the embodiments have primarily been described as being affixed to an arrow, they may also be affixed to other projectiles, such as darts, lawn darts, spears, javelins, model airplanes, toy rockets, or the like.

The vane 100 may be constructed of any material which provides a substantially rigid contour during arrow flight. Plastics or other synthetic materials are among included possible materials. The material may be resiliently bendable, such that, if outside force causes it to alter shape, it will return to its original contour. In other embodiments, the material may be rigid. In some embodiments, the material may be hollow or include hollowed out sections to reduce the weight.

The present invention can be fabricated in a variety of manners including casting individual vanes or fabricating a sheet from which the vanes can be cut. In another embodiment, strips of material with a pre-attached base can be fabricated and the vanes can be cut from the strips.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A vane for mounting to a projectile, the vane comprising:

a base for mounting on the surface of the projectile;

a vane fin including a contour defined by a bottom-edge, a rear-edge and a front-edge, and having a height H and a length L with a ratio of L to H being approximately 4 to 1, wherein:

the bottom-edge has a front point and a back point and is substantially linear between these points and is adjoined to the base;

the rear-edge has an upper point and a lower point and arcs from the lower point that corresponds to the back point of the bottom-edge, concave to the bottom edge, in an upward direction to the upper point of the back-edge; and the front-edge has an upper point and a lower point, the upper point of the front-edge corresponding with the upper point of the back-edge, and degrades from the upper point of the front-edge toward the lower point of the front edge which corresponds with the front point of the bottom-edge;

wherein the front-edge degrades towards the front point of the bottom-edge in a linear fashion at an angle Ø1 of approximately 20°±1° to a point P1 and then arcs concave to the bottom-edge downwardly from point P1 to the front point of the bottom-edge.

2. The vane of claim 1, wherein the height of the vane H is 0.465 inches with a tolerance of 2% or less.

3. The vane of claim 1, wherein the length of the vane L is 1.85 inches with a tolerance of 2% or less.

4. The vane of claim 1, wherein the height of the vane H is 0.465 with a tolerance of 2% or less and the length of the vane L is 1.85 inch with a tolerance of 2% or less.

5. The vane of claim 1, wherein the radius of the arc of the rear-edge is approximately 1.032 radians and the height of the vane H is approximately 0.465 inches with a tolerance of 2% or less.

6. The vane of claim 1, wherein the radius of the arc from point P1 to the front point of the bottom edge is 0.125±0.005 inches.

7. The vane of claim 1, wherein the front-edge degrades towards the front point of the bottom-edge in a linear fashion at an angle Ø1 of approximately 20°±1° to a point P2, then arcs concave to the bottom-edge downwardly from point P2 to point P1 at a first arc and then arcs concave to the bottom-edge downwardly from point P1 to the front point of the bottom-edge at a second arc.

8. The vane of claim 1, wherein the front-edge degrades towards the front point of the bottom-edge in an arc concave to the bottom-edge downwardly to point P1 at a first arc and then arcs concave to the bottom-edge downwardly from point P1 to the front point of the bottom-edge at a second arc.

9. A projectile including a plurality of vanes, each of the plurality of vanes comprising:

a base for mounting on the surface of the projectile;

a vane fin including a contour defined by a bottom-edge, a rear-edge and a front-edge, and having a height H and a length L have a ratio relationship of L to H of 4:1, wherein:

the bottom-edge has a front point and a back point and is substantially linear between these points and is adjoined to the base;

the rear-edge has an upper point and a lower point and arcs from the lower point that corresponds to the back point of the bottom-edge, concave to the bottom edge, in an upward direction to the upper point of the back-edge; and the front-edge has an upper point and a lower point, the upper point of the front-edge corresponding with the upper point of the back-edge, and degrades from the upper point of the front-edge toward the lower point of the front edge which corresponds with the front point of the bottom-edge;

wherein the front-edge degrades towards the front point of the bottom-edge in a linear fashion at an angle Ø1 of approximately 20°±1° to a point P1 and then arcs concave to the bottom-edge downwardly from point P1 to the front point of the bottom-edge.

10. The projectile of claim 9, wherein the height of the vane H is 0.465 with a tolerance of 2% or less and the length of the vane L is 1.85 inches with a tolerance of 2% or less.

11. The projectile of claim 9, wherein the radius of the arc of the rear-edge is approximately 1.032 radians, the height of the vane H is approximately 0.465 inches with a tolerance of 2% or less and the length of the vane L is 1.85 inches with a tolerance of 2% or less.

12. The projectile of claim 9, wherein the radius of the arc from point P1 to the front point of the bottom edge is 0.125±0.005 inches.

* * * * *